US007334353B2

(12) United States Patent
Lampkins

(10) Patent No.: US 7,334,353 B2
(45) **Date of Patent: *Feb. 26, 2008**

(54) STAY TIE II

(76) Inventor: Gary W. Lampkins, 1501 Aragona Blvd., Fort Washington, MD (US) 20744

( * ) Notice: Subject to any disclaimer, the term of this patent is extended or adjusted under 35 U.S.C. 154(b) by 0 days.

This patent is subject to a terminal disclaimer.

(21) Appl. No.: 10/046,164

(22) Filed: Jan. 16, 2002

(65) Prior Publication Data

US 2002/0059738 A1 May 23, 2002

Related U.S. Application Data

(63) Continuation-in-part of application No. 09/369,203, filed on Aug. 6, 1999, now Pat. No. 6,260,246.

(51) Int. Cl.
*A43C 71/00* (2006.01)

(52) U.S. Cl. ..... 36/50.1; 24/712.1; 24/712.6; 24/713; 24/713.6

(58) Field of Classification Search ..... 24/712.1, 24/712.6, 713, 713.6; 36/50.1, 51
See application file for complete search history.

(56) References Cited

U.S. PATENT DOCUMENTS 722,891 A * 3/1903 Pitman ..... 24/712.6
724,809 A * 4/1903 Clarkson ..... 24/712.6
1,088,067 A * 2/1914 Forbes ..... 36/50.1
1,834,401 A * 12/1931 Hoppe et al. ..... 24/712.6
4,514,882 A * 5/1985 Lavielle ..... 24/712.1
4,553,293 A * 11/1985 Blum ..... 36/50.1
4,790,048 A * 12/1988 Arnt ..... 24/712.1
4,879,787 A * 11/1989 Walls ..... 24/712.2
4,949,437 A * 8/1990 Anderson ..... 24/712.6
5,042,119 A * 8/1991 Williams ..... 24/712.6
5,097,573 A * 3/1992 Gimeno ..... 24/712.6
5,671,517 A * 9/1997 Gourley ..... 24/712.1
5,979,095 A * 11/1999 Schneider et al. ..... 40/633
6,260,246 B1 * 7/2001 Lampkins ..... 24/712.1

* cited by examiner

*Primary Examiner*—Jila M Mohandesi

(57) ABSTRACT

The devices sole purpose is to keep the integrity of a knot once it is formed with the shoe lace to keep the shoe securely fastened about the foot. This will be accomplished by precluding the bows and excess laces on each side of the knot from movement or slippage in any direction. The semi attached properties of the device will allow its user to remove it from one shoe and place it on another.

3 Claims, 1 Drawing Sheet

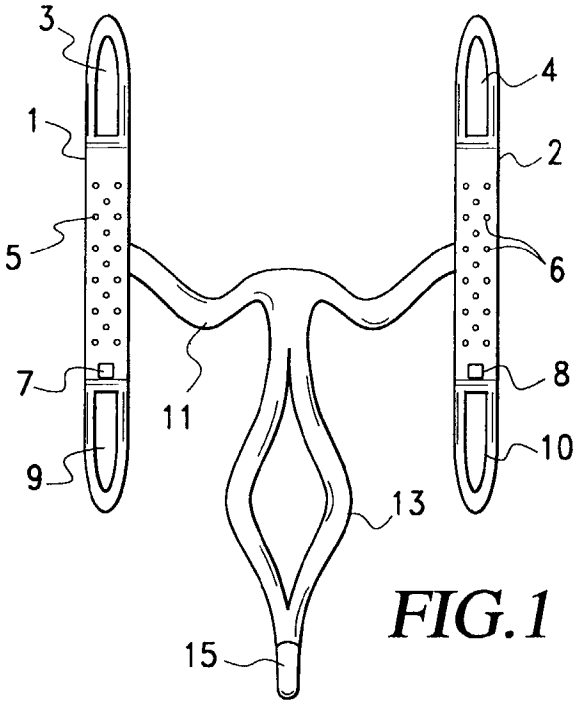
FIG.1
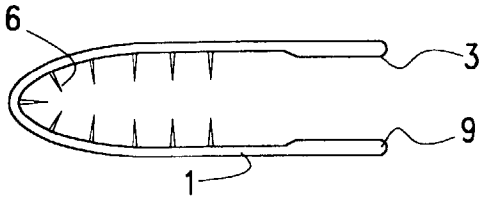
FIG.2
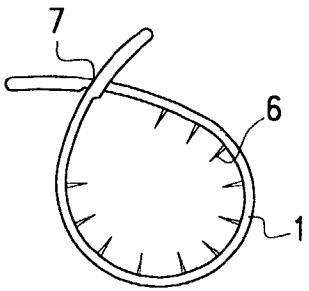
FIG.3
FIG.4
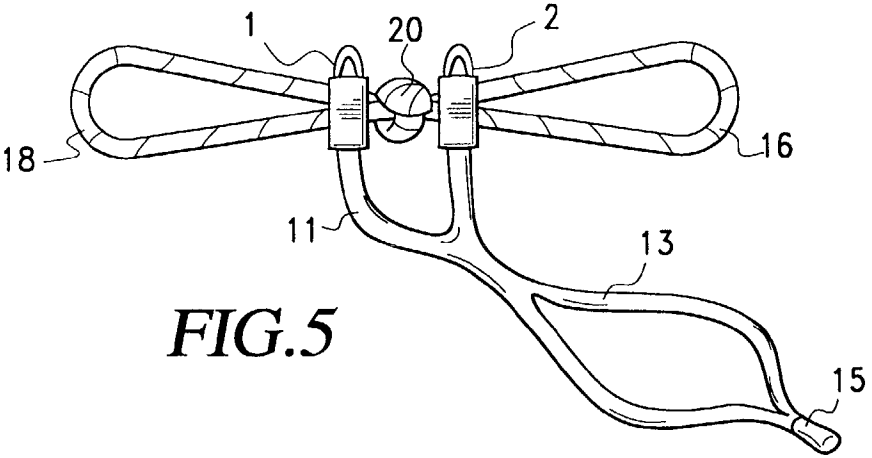
FIG.5

STAY TIE II

This is a continuation-in-part of application Ser. No. 09/369,203, filed Aug. 6, 1999 now U.S. Pat. No. 6,260,246

BACKGROUND OF THE INVENTION

One of the most troubling occurrences to shoes and their function is the frequency of the slippage of the shoelace knot once it has been tied. This is a dangerous matter when participating in any type of athletic activity or something as simple as walking. Moreover, most young children are unaware of the danger of an untied shoe and the severity of the injury it can cause when they inadvertently step on the loose lace with their other foot and cause themselves to trip. Needless to say it is quite painful, especially when the front teeth are lost in the process. In Stanfield U.S. Pat. No. 5,372,510 where a device was designed to aid handicapped children in tying a bow in a shoelace that is mounted to a shoe. In short, prior art does not provide a remedy for slippage of the knot on both sides of the knot once the shoelace has been tied, nor does it address the semi or permanent need for placement of the device on the shoe itself to eliminate loss or destruction.

SUMMARY OF THE INVENTION

The primary function of the present invention is to keep shoelaces that have been tied in the traditional knot with bows on each side, securely fastened in the tied state. The device has two arm members, both with a slot in them to wrap securely around the shoelace bow, an arm connecting the two arms together, and a flexible arm in the shape of an oval with a stiff tip at one end of it to allow the device to be secured to the shoe through a shoelace hole of the shoe. Once placed through the shoelace hole the device will be inserted through the oval to form a noose around the shoe material, which will semi affix the device to the shoe.

The enclosed drawings and the preferred embodiments will fully describe the unique, practical usefulness of the invention.

BRIEF DESCRIPTION OF THE DRAWINGS

FIG. 1 Is a top open view of the device.

FIG. 2. Is a side view of one arm illustrating the teeth.

FIG. 3. Is a side view of one arm of the device with one end of the arm inserted in the slot of the arm.

FIG. 4. Is a side view of one arm displaying the teeth and the Velcro on both ends of the arm.

FIG. 5. Is an over head view of the device fastened around the shoelace once it has been tied with the traditional bows on the ends.

DESCRIPTION OF THE PREFERRED EMBODIMENTS

FIG. 1 illustrates an arm 1 with a hook and loop fastening means, 3 attached at the tip of arm 1. In the middle of arm

1 are teeth 5 with slot 7 next to teeth 5 and a hook and loop fastening means 9 at the other end of arm 1. Arm 1 and arm 2 are connected to each other by arm extension 11. Arm 2 serves the same purpose as arm 1 in which there is a hook and loop flistening means 4, and teeth 6 with slot 8 and hook and loop fastening means 10 all embodied on or in arm 2. Arm extension 11 is made a part of oval extension 13 with tip 15 on the end.

FIG. 2 shows the arm 2 with hook and loop fastening means parts 4 and 10 in relation to teeth 6 to illustrate a side view of one part of the device.

FIG. 3 Illustrates one end of arm 1 inserted through slot 7 which when wrapped tightly will engage teeth 5 to hold shoelace 18 in place while maintaining the integrity of the knot.

FIG. 4 Illustrates a side view of arm 1 to better display the position of a hook and loop fastening means 3 and 9 and teeth 5 in relationship to each other.

FIG. 5 Illustrates the device frilly engaged on both sides of knot 20 with arms 1 and 2 wrapped around bows 18 and 16 to maintain the integrity of the knot 20. Arm extension 11 connects arm 1 to arm 2 with oval extension 13 being displayed in its open state and unattached to a shoe. Tip 15 purpose is to allow the device to be easily inserted through a shoelace hole on a shoe with the device being inserted through oval extension 13 to form a semi-permanent noose around the shoe material

I claim:

1. A combination shoe and shoelace retaining device comprising of two substantially flexible wrapping interlocking retaining members with each having an adjusting means which extends through each flexible wrapping interlocking retaining member, joined together by a flexible arm, with a flexible loop extension attached thereto, which allows the device to be attached to a shoe by the flexible loop extension being inserted through a shoelace hole and inserted through said flexible loop to form a noose around the upper of the shoelace hole and surrounding shoe material, thereby allowing the device to be attached to said shoe.

2. A combination shoe and shoelace retaining device as described in claim 1 wherein the device is attached to a shoe.

3. A shoelace retaining device comprising of two substantially flexible wrapping interlocking members with each having an adjusting means, with said interlocking members having a plurality of interlocking members extending from a surface thereof, a flexible arm member extending between said flexible interlocking members, a flexible loop extension attached to said flexible arm, said flexible loop extension is adaptive to be inserted into a shoelace hole, said flexible loop extension being of a length that allows it to be inserted through itself and form a noose around the shoelace hole.

* * * * *